United States Patent [19]

Boede

[11] Patent Number: 4,875,656

[45] Date of Patent: Oct. 24, 1989

[54] STOWABLE PULL HANDLE FOR ELECTRIC TROLLING MOTOR SUPPORT APPARATUS

[75] Inventor: Robert H. Boede, Omro, Wis.

[73] Assignee: Brunswick Corporation, Skokie, Ill.

[21] Appl. No.: 213,692

[22] Filed: Jun. 30, 1988

[51] Int. Cl.[4] ..... F16M 13/00

[52] U.S. Cl. ..... 248/642

[58] Field of Search ..... 248/640–643, 248/231.8, 231.3, 51, 52, 320, 328, 231.6, 231.4; 24/298–302, 561, 562; 440/63, 6, 900

[56] References Cited

U.S. PATENT DOCUMENTS

| | | | |
|---|---|---|---|
| 990,346 | 4/1911 | Dreyer | 248/328 X |
| 1,575,177 | 3/1926 | Moran | 248/328 |
| 1,714,369 | 5/1929 | Howe, Jr. et al. | 248/328 X |
| 2,232,576 | 2/1941 | Webb | 24/298 |
| 2,976,593 | 3/1961 | Exton | 24/562 X |
| 3,040,990 | 6/1962 | Gotti | 24/562 X |
| 3,461,832 | 8/1969 | Vierling | 248/642 X |
| 3,481,570 | 12/1969 | Shettel | 248/231.8 |
| 3,861,628 | 1/1975 | Krieger | 248/642 |
| 3,865,335 | 2/1975 | Roller et al. | 248/642 |
| 3,978,610 | 9/1976 | Stubbmann | 248/231.8 X |
| 4,090,733 | 5/1978 | Altschul | 24/562 X |
| 4,483,070 | 11/1984 | Junkermann | 248/328 X |
| 4,708,670 | 11/1987 | Peters | 248/642 X |

FOREIGN PATENT DOCUMENTS

| | | | |
|---|---|---|---|
| 926773 | 5/1963 | United Kingdom | 248/642 |
| 1238141 | 7/1971 | United Kingdom | 74/492 |

*Primary Examiner*—Alvin C. Chin-Shue

*Attorney, Agent, or Firm*—Robert C. Curfiss

[57] ABSTRACT

The manual operating cord for a deck-mounted electric trolling motor includes a handle which is demountably attachable to an arm of the pivotal motor support apparatus when the motor is in the operative or stowed position. The demountable handle assures that the operating cord will always be readily accesible to the operator in the boat to either raise the motor from its operative position or lower it thereto from its stowed position on the deck. The handle is demountably secured to one of the pivot arms of the motor support apparatus by frictional engagement between the legs of an elongated U-shaped slot in the handle and the lateral faces of the pivot arm.

6 Claims, 2 Drawing Sheets

STOWABLE PULL HANDLE FOR ELECTRIC TROLLING MOTOR SUPPORT APPARATUS

BACKGROUND OF THE INVENTION

The present invention relates to a pivotal support for mounting an electric trolling motor on a boat and, more particularly, to an improved handle construction for the operating cord used to facilitate manual pivotal movement of the motor on the support apparatus.

Small electric trolling motors are well known and have long been used to provide slow speed movement and maneuverability for various types of small watercraft. In most cases, the boat or other watercraft utilizing an electric trolling motor will have a larger internal combustion engine, such as an outboard motor, as its primary source of motive power. Thus, trolling motors are usually used only to provide slow speed action to baits or lures trolled behind the boat, to maneuver the boat into position, or to maintain the boat in position against drifting or movement in a current.

When not in use, an electric trolling motor is usually raised out of the water by pivoting it on its mount and allowing it to lie in a generally horizontal position in or on the boat. One type of electric trolling motor in common use includes a motor support apparatus mounted to the deck of the boat. A deck-mounted motor is usually attached to the forward horizontal deck and includes a specially designed pivotal support apparatus for moving the motor between its operative and stowed positions and for holding it in either of the selected positions. Examples of such support apparatus for deck-mounted motors are shown in U.S. Pat. No. 3,999,500 and 4,410,161.

In addition to the pivotal mounting mechanism, the typical electric trolling motor includes an upper control head with a steering arm or extension for the attachment of electric power or remote control wires, a lower drive unit containing the electric motor and propellor, and a tubular support interconnecting the control head and the drive unit. The tubular connector is journaled in a column housing which, in turn, is pivotally connected to the support apparatus for rotational movement of the motor between an operative position with the tubular connector disposed generally vertically and a stowed position with the tubular connector disposed generally horizontally and the motor lying atop the deck. The journaled mounting of the tubular connector in the column housing also allows axial rotation of the tube for steering the motor and linear axial movement of the tube within the column housing to provide vertical adjustment of the position of the motor/propellor unit.

In a deck-mounted trolling motor support apparatus, the motor is moved back and forth between its operative and stowed positions by manually lifting it and pivoting it between the positions. The prior art mechanisms disclosed in the above mentioned patents include pivot arms which extend between the column housing on the motor and the support apparatus base attached to the deck of the boat and the arms are constructed and positioned to provide a rotatable linkage which automatically orients the motor as it is rotated between positions. To facilitate operator movement of the motor, an operating cord is attached at one end to the motor and has a handle attached to the other end which is grasped by an operator inside the boat. The operating cord allows the operator to lower the motor into its operating position and to retract by pulling it from its operating position upwardly and rearwardly about the pivotal support apparatus when it is desired to stow the motor atop the deck.

The operating cord is generally attached to the motor near the pivotal connection between the column housing and a pivot arm. The cord must obviously be long enough to span the length of the deck when the motor is in its operative position such that the handle is readily accessible to the operator inside the boat. When the motor is retracted to its stowed position by manually pulling it upwardly and rearwardly with the operating cord, virtually the full slack length of cord will lie on the deck adjacent the operator's position inside the boat. When the motor is in either of its positions, it is desirable to have the operating cord handle located such that it is easily accessible to the operator. Further, it is desirable that the handle be secured against inadvertent movement away from the operator position as a result, for example, of rocking or bouncing movement of the boat. Indiscriminate movement of the cord and handle not only inhibits access and ease of operation, but is asthetically undesirable.

Attempts have been made to provide means for storing the slack operating cord and/or securing the operating handle, but such means and devices have been cumbersome to operate and/or of complex and unreliable operation. Thus, devices such as automatic cord retractors or cord winding mechanisms have been found to be generally too complex or unreliable.

SUMMARY OF THE INVENTION

The present invention solves the problems of securing and facilitating access to a trolling motor operating cord by providing a cord handle which may be demountably secured to the motor support apparatus in either the operative or stowed position and at a location which readily accessible to the operator.

The improved operating cord handle of the present invention is particularly adapted for use with a pivotal motor support apparatus which includes a support base attached to the boat deck, a pivot arm or arms interconnecting the motor and the base, with one end of the operating cord attached to the apparatus near the pivotal connection between the motor and a pivot arm. The handle includes a body adapted to be readily grasped by hand, means for attaching the other end of the operating cord thereto, and a securement means for demountably attaching the handle to a pivot arm. Preferably, the securement means comprises a slot extending the length of the handle body dimensioned to be pressed onto and frictionally engage the pivot arm.

The demountable handle is particularly adapted for use with a motor support apparatus in which at least one of the pivot arms is of substantially uniform rectangular cross section such that the handle may be secured to either edge of the arm, depending on the position of the motor. The faces of the slot in the handle may be provided with ribs to facilitate the frictional engagement with the opposing faces of the pivot arm. The slot may have a substantially U-shaped cross section, conforming generally to the rectangular cross section of the pivot arm, and a depth sufficient to provide adequate contact between the respective faces of the slot and the pivot arm.

DETAILED DESCRIPTION OF THE PREFERRED EMBODIMENT

Figure 1:
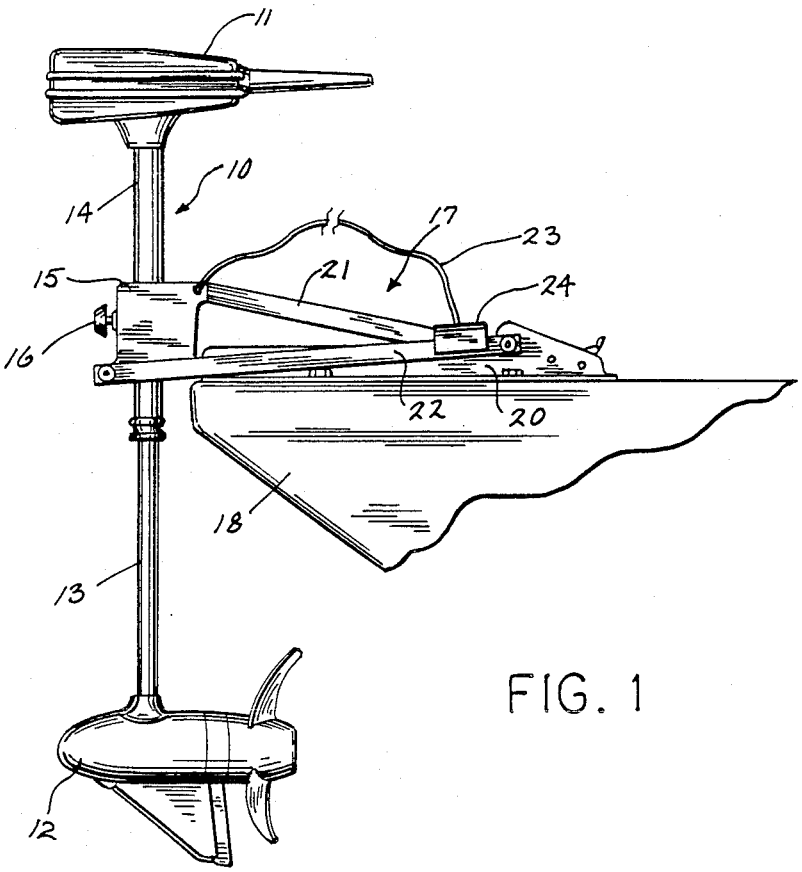
FIG. 1 is a side elevation of the forward portion of a boat showing a deck-mounted trolling motor and pivotal support appartus with the motor disposed in its operative position and the operating cord handle of the present invention secured to the support apparatus.
Figure 2:
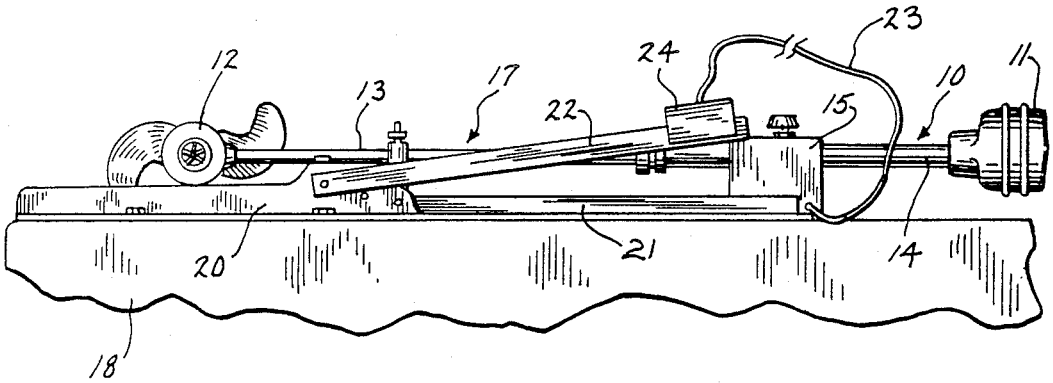
FIG. 2 is a side elevation similar to FIG. 1, but showing the motor disposed in its generally horizontal stowed position.

An electric trolling motor 10 includes an upper control head 11 and a lower drive motor and propellor unit 12 which are mounted on opposite ends of a connecting tube 13. The connecting tube is journaled within a shorter swivel tube 14 to provide axial rotation of the connecting tube 13 and attached control head 11 and propellor unit 12 for steering movement. The swivel tube 14, in turn, extends through a column housing 15 within which the swivel tube is slidable axially to provide vertical height adjustment of the drive unit 12. An adjustment knob 16 operates a clamping mechanism within the column housing 15 to secure the swivel tube and attached motor in the selected vertical position. A pivotal motor support apparatus 17 mounts the motor 10 to the horizontal deck of a boat 18 for movement between a generally vertically disposed operative position, shown in FIG. 1, and a generally horizontally disposed stowed position, shown in FIG. 2. The motor support apparatus 17 includes a support base 20 attached to the deck of the boat and a series of pivot arms interconnecting the base 20 and the column housing 15 of the motor 10. The pivot arms include a central pivot arm 21 pivotally attached at one end to the aft end of the support base 20 and at its other end to the upper aft end of the column housing 15. A pair of lateral pivot arms 22 lie generally parallel to and on opposite sides of the central pivot arm 21. The lateral pivot arms 22 are attached at one end to a common pivot on the support base forward of the pivotal connection of the central pivot arm 21 and at their other ends to a common pivot on the forward lower edge of the column housing 15. The lateral pivot arms 22 are identical and are equal in length to the central pivot arm 21. Manual rotation of the motor 10 from either of its FIG. 1 or FIG. 2 positions to the other position results in 90° rotation of the motor and substantially 180° rotation of the pivot arms 20 and 22. The construction and operation of the motor support apparatus 17 is convential and described in more detail in U.S. Pat. No. 4,410,161.

An operating cord 23 for the motor support apparatus is attached at one end to the column housing 15, preferably near one of the pivotal connections of a pivot arm thereto. In the embodiment shown, the operating cord 23 is attached near the pivotal connection of the central pivot arm 21 and the column housing 15. The exact point of connection is not critical, but should be high enough with respect to the pivotal connections of the pivot arms 21 and 22 to the support base 20 to provide leverage to facilitate rotational movement from the operating position in FIG. 1 as the operator pulls on the cord from within the boat.

Figure 3:
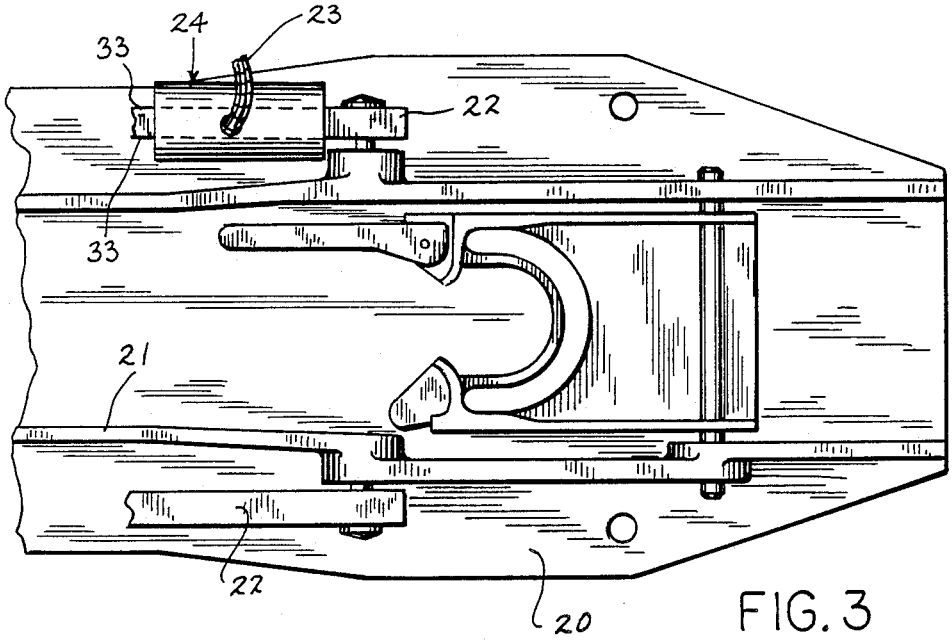
FIG. 3 is an enlarged top plan view of a portion of the support apparatus with the operating cord handle shown attached to a pivot arm.
Figure 4:
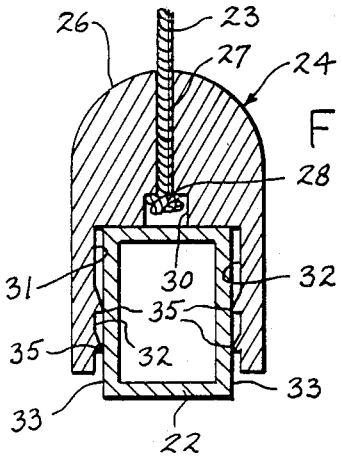
FIG. 4 is a vertical section taken on line 4—4 of FIG. 3.

Referring also to FIGS. 3 and 4, the lateral pivot arms 22 are preferably constructed from aluminum extrusions and have a rectangular cross section. The handle 24 of the present invention is attached to the other end of the operating cord 23 and is, in general, shaped similar to a typical pull cord handle. Thus, the handle 24 includes an elongated body 25 including a rounded upper surface 26 adapted to be grasped by the hand and fingers of the operator. The operating cord 23 extends through a hole 27 in the upper surface 26 of the handle body and is secured therein by a knotted end 28 in a counterbore 30 at the inner end of the hole 27.

The lower surface of the handle is provided with an elongated slot 31 which extends the full length of the body 25. The slot 31 is just slightly narrower than the width of the rectangular lateral arm 22 such that the handle may be pressed onto the upper edge of one of the lateral pivot arms 22 an be held thereon by frictional engagement between the opposite inside faces 32 of the slot 31 and the lateral faces 22 of the pivot arm between the upper and lower edges thereof. The slot 31 is of a generally U-shaped cross section and preferably has a depth just slightly less than the corresponding dimension of the lateral faces 33 of the pivot arm on which the handle is demountably secured.

Figure 5:
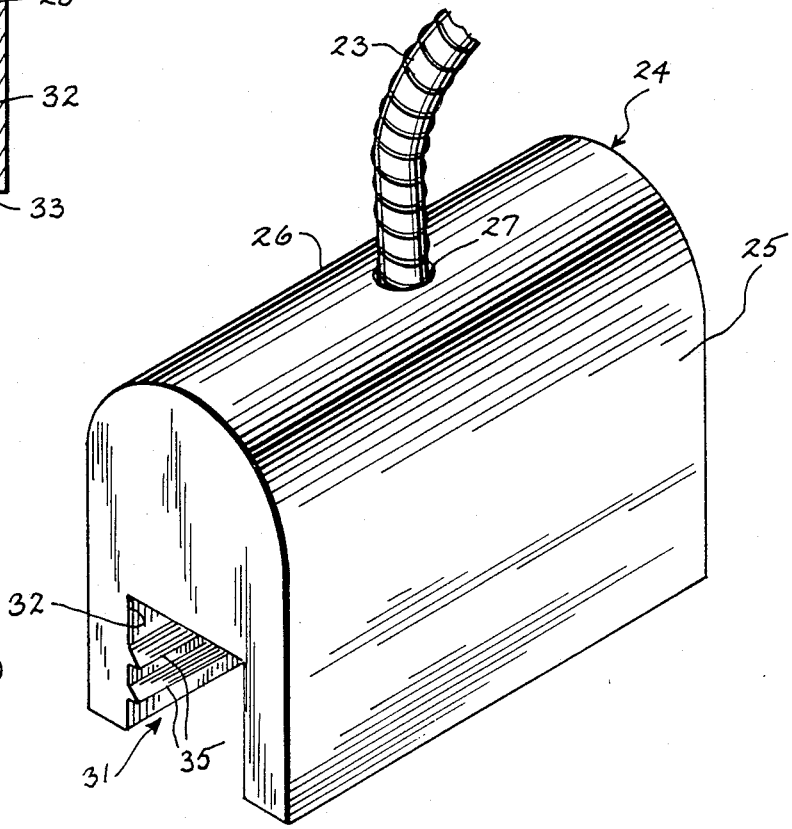
FIG. 5 is an enlarged perspective view of the handle of the present invention.

The handle 24 may be made of any suitable material, a molded plastic material being preferred. A suitable plastic material will provide some flexibility to the legs 34 defining the opposite inside faces 32 of the slot, such that sight deflection thereof as the handle is pressed onto the pivot arm will enhance frictional engagement therebetween. Referring particularly to FIG. 5, the opposite inside faces 32 of the slot 31 may be provided with one or more ribs 35 to provide the necessary engagement with the lateral faces 33 of the pivot arm and yet not be so tight as to inhibit attachment or removal. The ribs may be disposed in a longitudinal orientation, as shown, or may be disposed vertically or at an intermediate angle. lateral pivot arm 22 in one position of the motor will be disposed as the bottom edge as the arms are rotated 180° to move the motor to the other positon. However, because the lateral pivot arms 22 have a uniform rectangular cross section, the handle 24 may be demountably attached to the upwardly facing edge of the arm regardless of the position of the motor 10.

The handle of the pressent invention may thus be demountably but securely fastened to a pivot arm in either the stowed or operative positions of the motor, so that the handle is always readily accessible to the operator, and the handle along with the operating cord is not subject to be inadvertently moved to an inconvenient or inaccessible location. Finally, some order and neatness is retained to the general positioning of the handle and cord to enhance the asthetics of the entire mounting assembly.

I claim:

1. In a deck mounted electric trolling motor including a pivotal motor support apparatus mounting the motor for movement between an operative position and a horizontal stowed position on the deck, the support apparatus including a support base attached to the deck, pivot arms pivotally interconnecting the motor and the base, and an operating cord attached at one end to the pivotal interconnection between the motor and the pivot arms to facilitate manual lowering of the motor to its operative position and retraction of the motor to its stowed positon, an improved operating cord handle comprising:

a manually engageable body;

said operating cord attached at its other end to the body; and, a slot in the body receiving and frictionally engaging the edge of one of said pivot arms and demountably securing the handle to said arm in a fixed position in either the operative or stowed position of the motor.

2. The apparatus as set forth in claim 1 wherein said slot extends the length of the body.

3. The apparatus as set forth in claim 1 wherein said pivot arm is of uniform rectangular cross section along a substantial portion of its lenght such that said slot receives and frictionally engages either of the opposite edges of said pivot arm.

4. The apparatus as set forth in claim 3 including ribs extending along opposite faces of said slot said ribs frictionally engaging the faces of said pivot arm extending between said opposite edge thereof.

5. The apparatus as set forth in claim 4 wherein said slot is substantially U-shaped in cross section.

6. The apparatus as set forth in claim 5 wherein the slot has a depth less than the width of the faces of said pivot arm engaged thereby.

* * * * *